US011073255B2

(12) United States Patent
Vincent et al.

(10) Patent No.: US 11,073,255 B2
(45) Date of Patent: Jul. 27, 2021

(54) LOW PROFILE ASSEMBLY FOR LED DOWNLIGHT WALL WASH WITH LOW VERTICAL ATTENUATION AND HIGH LATERAL UNIFORMITY

(71) Applicant: Principal Lighting Group, LLC, San Angelo, TX (US)

(72) Inventors: J. Bryan Vincent, San Angelo, TX (US); Gerald Bruce Davis, Houston, TX (US); Robin Lynn Hood, Houston, TX (US); John R. Fox, San Leon, TX (US)

(73) Assignee: Principal Lighting Group, LLC, San Angelo, TX (US)

( * ) Notice: Subject to any disclaimer, the term of this patent is extended or adjusted under 35 U.S.C. 154(b) by 0 days.

(21) Appl. No.: 16/853,425

(22) Filed: Apr. 20, 2020

(65) Prior Publication Data

US 2020/0248889 A1 Aug. 6, 2020

Related U.S. Application Data

(63) Continuation of application No. 16/368,421, filed on Mar. 28, 2019, now Pat. No. 10,627,077.

(60) Provisional application No. 62/649,259, filed on Mar. 28, 2018.

(51) Int. Cl.

| | |
|---|---|
| ***F21V 7/00*** | (2006.01) |
| ***F21S 8/02*** | (2006.01) |
| ***F21V 21/00*** | (2006.01) |
| ***F21V 5/04*** | (2006.01) |
| *G09F 13/02* | (2006.01) |
| *F21Y 115/10* | (2016.01) |
| *F21Y 103/10* | (2016.01) |

(52) U.S. Cl.

CPC ..... *F21V 7/0008* (2013.01); *F21V 5/04* (2013.01); *F21V 7/005* (2013.01); *F21V 21/00* (2013.01); *F21Y 2103/10* (2016.08); *F21Y 2115/10* (2016.08); *G09F 13/02* (2013.01)

(58) Field of Classification Search

CPC . F21S 8/024; F21S 8/003; F21S 8/033; F21V 7/0008

See application file for complete search history.

(56) References Cited

U.S. PATENT DOCUMENTS

| | | | | |
|---|---|---|---|---|
| 5,032,058 A * | 7/1991 | Williams | F04B 9/107 33/DIG. 15 |
| 10,627,077 B2 * | 4/2020 | Vincent | F21V 5/04 |
| 2017/0234523 A1 * | 8/2017 | Krijn | E04F 19/0436 362/145 |

* cited by examiner

*Primary Examiner* — Karabi Guharay
(74) *Attorney, Agent, or Firm* — Jackson Walker L.L.P.

(57) ABSTRACT

A downlight eyebrow includes an elongated L-shaped structure including a first wall and a second wall forming a right angle. The downlight eyebrow may be installed at an upper edge of a vertical structure with the first eyebrow wall extending horizontally away from an upper edge of the structure and the second wall extending vertically downward from the first wall. A reflective material disposed on an interior surface of the second wall provides a primary reflector. A flange that extends from an intermediate point in the eyebrow, downward and away from the second wall, toward the vertical surface may provide a secondary reflector.

18 Claims, 3 Drawing Sheets

LOW PROFILE ASSEMBLY FOR LED DOWNLIGHT WALL WASH WITH LOW VERTICAL ATTENUATION AND HIGH LATERAL UNIFORMITY

FIELD OF INVENTION

Disclosed subject matter pertains to commercial lighting and, more particularly, commercial lighting employing light emitting diode (LED) technology.

BACKGROUND

Commercial establishments frequently deploy signage to identify and promote their establishments. Signage is often illuminated, especially at night, and often through the use of downlighting. Downlighting refers to the use of lights positioned above a region of intended illumination and configured to shine light generally downward. Conventional downlighting apparatus, however, tend to be undesirably visible or conspicuous, particularly when the illuminated region is elevated. Conventional downlighting also tends to produce an illumination pattern that is undesirably non-uniform and/or has undesirably high vertical attenuation.

SUMMARY

One embodiment of a downlight assembly disclosed herein includes an elongated downlight eyebrow, an LED string comprising a plurality of LED modules, and two or more reflectors including a primary reflector oriented at a first angle relative to the illuminated region and a secondary reflector oriented at a second angle relative to the illuminated region.

In at least some embodiments, the downlight eyebrow comprises an elongated L-shaped structure including a first wall and a second wall that may form an angle of approximately 90 degrees. The downlight eyebrow may be installed at or in proximity to an upper edge of a wall, fascia, or other type of vertical structure with the first wall of the eyebrow extending horizontally away from an upper edge of the vertical structure. In this configuration, the second wall of the downlight eyebrow may be oriented in a vertical or substantially vertical plane, extending downward from the first wall, parallel or substantially parallel with the illuminated region and displaced from the illuminated region by a width of the first wall. In some embodiments, a reflective material, film, or coating may be disposed on an interior surface of the second wall of the downlight eyebrow, wherein the interior surface of the second wall functions as the primary reflector. The secondary reflector may be implemented as a flange that extends downward and away from an intermediate point in the first wall, towards the vertical surface. In other embodiments, the secondary reflector may be implemented as an elongated and winged or angled mounting structure referred to herein as a winged rail. In at least some embodiments, the winged rail includes a mounting wing and a reflective wing that form an obtuse angle, referred to herein as the wing angle. The LED string may be affixed to an inward or lower surface of the mounting wing while the outward or upper surface of the mounting wing may be affixed to an interior surface of the downlight eyebrow first wall.

The mounting wing and the reflective wing of the winged railed may be sized and angled wherein a horizontal dimension of the winged rail as a whole is equal to or substantially equal to the displacement of the second wall from the illuminated region. In such embodiments, the displacement between each of the LED modules affixed to the mounting wing and the illuminated region is determined and maintained by dimensions of the winged rail. The reflective wing may extend from the mounting wing, in an outward and downward direction, terminating at or near the vertical structure. In this configuration, the reflective wing may lie in a plane that forms an acute angle with a plane in which the downlight eyebrow first wall lies. This secondary reflector beneficially improves uniformity and intensity of the illuminated region and, in addition, provides a mechanical benefit by maintaining the position of the LED modules affixed to the mounting wing of the winged rail. In other embodiments, the eyebrow frame may include snap attach tabs formed on the first wall and LED modules may be snap-attached to the first wall via the snap attach tabs. Because the LED modules are held in place by the snap attach tabs, these embodiments need not employ a reflective wing having a length sufficient to abut the structure and thereby maintain the LED modules in a fixed position.

In some embodiments, each LED module in the LED string may include one or more LED lamps and a compound, narrow beam lens. The narrow beam lens may be characterized by first and second beam angles where the first beam angle is applicable to light lying in a first vertical plane, e.g., a vertical plane that is substantially parallel to the illuminated region, and the second beam angle is applicable to light lying in a second vertical plane, e.g., a vertical plane that is substantially perpendicular to the illuminated region. In at least one embodiment, both beam angles are less than 45 degrees. One or more embodiments employ LED modules with compound lenses in which the first beam angle is in the range of 10 to 20 degrees and the second beam angle is in the range of 25 to 35 degrees. One or more embodiments may include compound lenses in which the first beam angle is approximately 15 degrees and the second beam angle is approximately 30 degrees. An exemplary and commercially distributed LED module featuring a compound lens meeting one or more of these criteria is the Street Fighter POD 3 module from Principal Lighting Group.

A combination of various characteristics of the assembly as disclosed herein produces a downlight wall wash with low lateral variation in intensity and extended vertical coverage using an eyebrow with an extremely low profile. For example, subject matter disclosed herein encompasses a downlight assembly that includes a frame structure, referred to herein as an eyebrow or an eyebrow frame, an LED string affixed to the eyebrow frame, and reflectors including a primary reflector and a secondary reflector. The LED string may include one or more LED modules, each of which may include one or more LEDs.

In at least some embodiments, the eyebrow frame may be an extruded structure or another type of monolithic fabrication. In at least some other embodiments, the eyebrow frame may include two or more fabricated components that are assembled or otherwise connected to form the eyebrow structure.

The eyebrow frame may be configured to attach to a structure such that the downlight assembly illuminates some or all of the structure. The portion of the structure illuminated by the downlight assembly may be referred to herein as the illuminated region. The structure to which the downlight assembly is configured to attach may be a vertical structure such as a wall or fascia of a building, canopy, or the like and the eyebrow frame may be configured to attach to an upper edge of the vertical structure such that the illuminated region includes at least an upper portion of the vertical structure.

In some embodiments, the eyebrow frame includes a first wall, which is horizontal or primarily horizontal, and a second wall, which is vertical or substantially vertical. In at least some of these embodiments, one end of the first wall is affixed to the vertical structure at or near an upper edge of the vertical structure such that the first wall is perpendicular or roughly perpendicular to the vertical structure and coplanar with an upper surface of the vertical structure. The second wall may extend downward from a second end of the first wall such that the second wall is parallel or roughly parallel with the vertical structure. In such embodiments, a cross section of the eyebrow frame forms an inverted "L" wherein a first leg of the inverted L corresponds to the first wall and a second leg of the inverted L corresponds to the second wall.

In at least one embodiment, the LED string is affixed to a lower surface of the first wall in an inverted configuration, with the LED lamps oriented below a substrate in which the LED lamps are embedded, attached, or fabricated. The LED string may be positioned adjacent to or in close proximity to the second wall. In such embodiments, the height, i.e., vertical dimension, of the second wall may be quite low and still conceal the LED modules from external view, which is generally desirable in a wide variety of commercial and residential lighting applications.

The primary reflector may be an interior surface of the second wall of the eyebrow frame or a reflective coating or film applied, adhered, or otherwise affixed to the interior surface of the second leg. In some embodiments, the downlight assembly may include one or more seam plates providing mechanical reinforcement to the eyebrow frame. In such embodiments, the downlight assemble may include a second wall seam plate affixed to the eyebrow frame in proximity to the second wall. In such embodiments, the second wall seam plate or a coating or film applied to a surface of the second wall seam plate may serve as the primary reflector.

The primary reflector may be configured to reflect at least some of the light produced by the LED string onto the illuminated region. In at least some embodiments, the primary reflector is parallel or substantially parallel to the illuminated region. In other embodiments, the primary reflector may be oriented at an angle with respect to the illuminated region.

The secondary reflector may be a secondary reflector oriented at a second angle relative to the illuminated region, wherein the first angle and the second angle differ and wherein the first reflective plane and the second reflective plane are configured to influence the illumination of the illuminated region.

The primary reflector may be implemented as an inner surface of the second wall, a reflective coating applied to the inner surface of the second wall, or a surface of a seam plate affixed to the eyebrow frame in proximity to the second wall. The downlight assembly may include one or more seam plate tabs configured to retain the seam plate in proximity to the second wall. The eyebrow frame may include a flange, wherein a first end of the flange is attached to an intermediate point of an interior surface of the first leg and wherein the flange defines an acute angle with the first leg. The secondary reflector may be implemented as a surface of the flange or the surface of a secondary seam plate. The eyebrow frame may include one or more secondary seam plate tabs configured to retain the secondary seam plate in proximity to the flange.

The first wall of the downlight assembly may include a slightly sloped or inclined portion oriented at a small angle sufficient to guide water towards the vertical structure. The first wall of the eyebrow frame may include snap fit tabs suitable for receiving and maintaining a position of the LED string. The eyebrow frame may further include a water tab formed at an upper end of the second wall to deter water from running over an exterior or visible surface of the second wall.

Each of the plurality of LED modules may include one or more LEDs and a narrowing lens, wherein the narrowing lens constrains dispersion of light from the one or more LEDs. In such embodiments, the narrowing lens may constrain dispersion of light in a particular plane, wherein the particular plane is perpendicular to the illuminated region. The narrowing lens may constrain dispersion of light in a particular plane, wherein the particular plane is parallel to the illuminated region. The narrowing lens may constrain dispersion of light in a particular plane in accordance with a particular beam angle, wherein the particular beam angle is less than or equal to 60 degrees. In some embodiments, the particular beam angle may be less than or equal to 45 degrees. The narrowing lens may be a compound narrowing lens that constrains dispersion of light in a first particular plane in accordance with a first beam angle and further wherein the compound narrowing lens constrains dispersion of light in a second particular plane in accordance with a second beam angle. In at least one compound lens embodiment, the first particular plane is perpendicular to the second particular plane, the first beam angle is in the range of 10 degrees to 20 degrees and the second beam angle is in the range of 25 to 35 degrees.

In some embodiments, the eyebrow frame comprises an extruded eyebrow frame formed as a monolithic structure with an extrusion process. In other embodiments of the downlight assembly, the eyebrow frame may be implemented as an assembled or fabricated frame, wherein the assembled frame includes two or more components affixed to each other to form the eyebrow frame.

DETAILED DESCRIPTION

Figure 1:
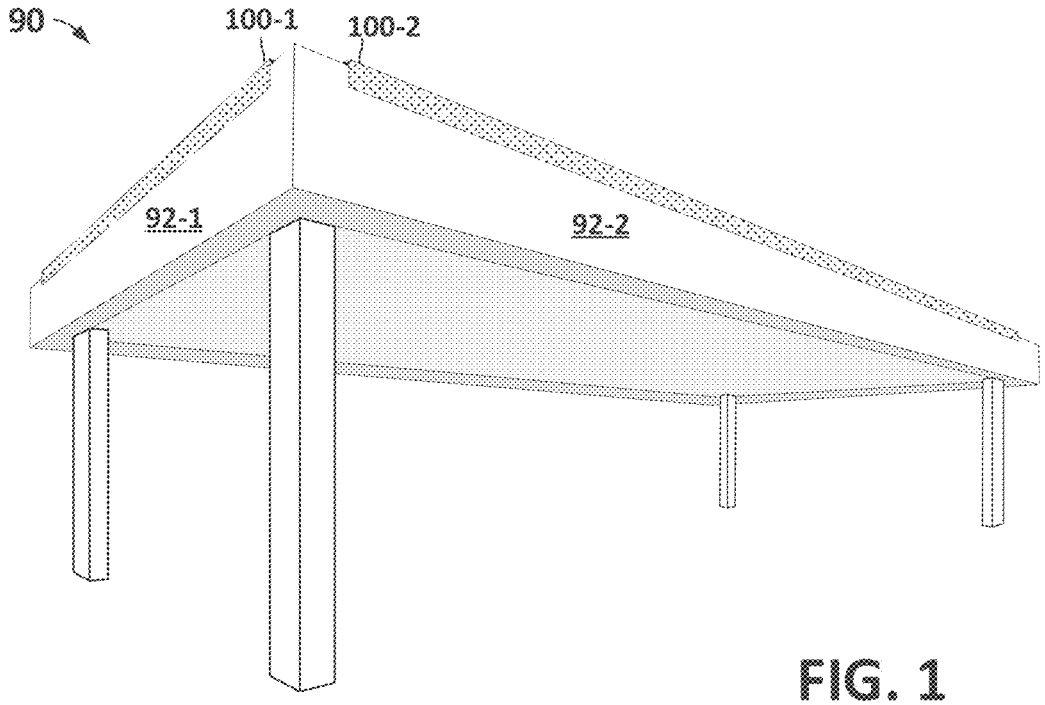
FIG. 1 illustrates a perspective view of a canopy structure including a disclosed LED downlight assembly for producing a downlight wall wash on a fascia panel of the canopy or on another surface of intended illumination.

References to horizontal or lateral orientations, directions, or movement refer to orientation, direction, or movement in a plane that is perpendicular to the force of gravity while references to vertical orientation, direction, or movement refer to orientation, direction, or movement in a plane that is parallel to the force of gravity. In addition, although the embodiments illustrated in the drawings emphasize wall washes produced on vertically oriented surfaces using a downlight assembly positioned at or near the top of the illuminated surface, other embodiments not explicitly depicted may produce analogous wall washes on horizontally oriented surfaces as well as surfaces that are neither horizontal nor vertical.

FIG. 1 illustrates a perspective view of a commercial canopy 90 with two vertically oriented fascia panels 92 and two downlight assemblies 100. The first downlight assembly 100-1 is illustrated affixed to a top edge of first fascia panel 92-1 and the second downlight assembly 100-2 is illustrated affixed to a top edge of the second fascia panel 92-2. Although not drawn to scale, FIG. 1 will convey to one of ordinary skill in the field of commercial lighting that the illustrated downlight assemblies 100 have a desirable low profile and low visibility with respect to the fascia panels 92 and the commercial canopy 90 as a whole. As illustrated in FIG. 1, each fascia panel 92 corresponds to a surface of intended illumination (illuminated region) wherein the first fascia panel 92-1 represents the illuminated region of first downlight assembly 100-1 while the second fascia panel 92-2 represents the illuminated region of second downlight assembly 100-2. Although FIG. 1 illustrates two downlight assemblies 100, one on each of the visible fascia panels 92, other embodiments may include two or more downlight assemblies 100 on any one or more of the fascia panels 92, zero downlight assemblies 100 on any of the fascia panels 92, and so forth. Similarly, although FIG. 1 illustrates downlight assemblies 100 that do not extend the entire length of the corresponding fascia panels 92, other embodiments may include downlight assemblies 100 that extend the entire length of the applicable fascia panel 92.

In the field of external lighting for commercial and/or retail establishments, it is generally considered desirable to illuminate logos and other branding elements including, in at least some instances, exterior walls and other vertical surfaces of the applicable establishment. The lighting effect associated with illuminating a large illuminated region is sometimes referred to as a wall wash and, when the wall wash is established by lamps disposed above all or most of wall wash, the lighting effect is sometimes referred to as a downlight wall wash. The downlight assemblies 100 illustrated in FIG. 1 produce downlight wall washes on the respective fascia panels 92.

The quality and/or efficacy of a downlight wall wash produced by a downlight assembly 100 may be evaluated and/or at least partially quantified in terms of certain parameters including as non-limiting examples, the peak wall wash intensity, the wall wash's lateral uniformity of intensity, the vertical extent or coverage of the wall wash, which corresponds to a vertical attenuation of the wall wash, the spacing between adjacent light source lamps, the per lamp and per assembly power consumption, the per lamp and per assembly cost, and the profile of the downlight assembly eyebrow.

The downlight assembly's eyebrow profile influences other parameters of interest including the horizontal displacement between the illuminated region each of lamp. The downlight assembly eyebrow generally includes a vertical dimension and a horizontal dimension and it is desirable to minimize both while maintaining a high quality wall wash and while concealing the light source lamps from visual detection. Disclosed downlight assemblies achieve wall washes of high intensity, low lateral variation and low vertical attenuation with a low profile downlight eyebrow.

Figure 2:
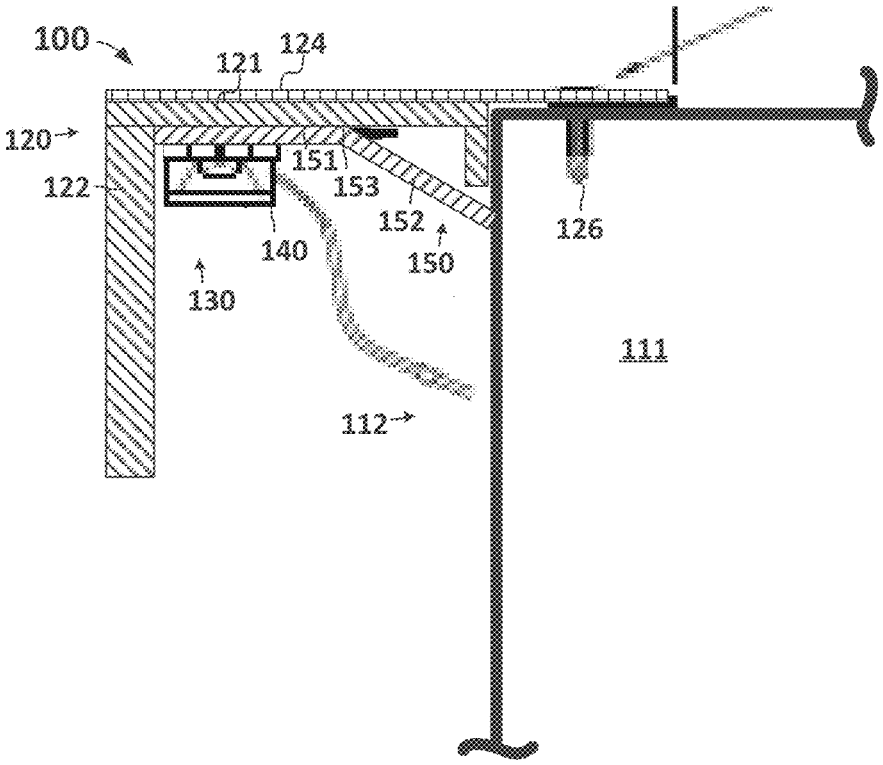
FIG. 2 illustrates a side view of a disclosed downlight assembly.
Figure 3:
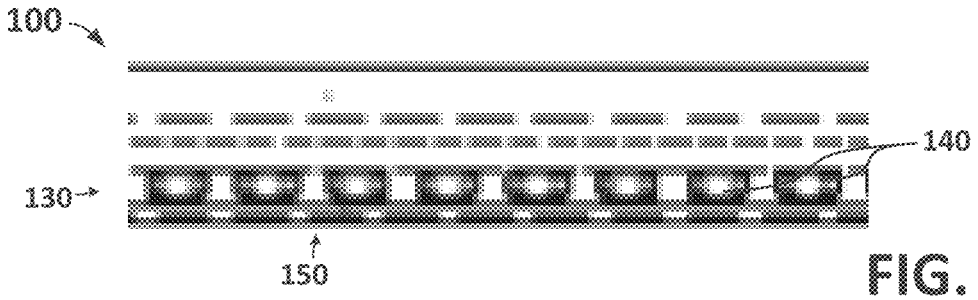
FIG. 3 illustrates a plan view of a portion of a disclosed downlight assembly.
Figure 4:
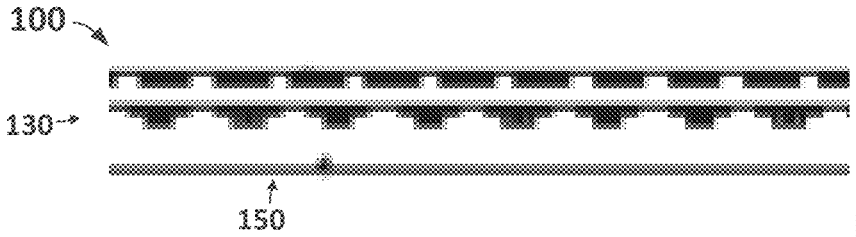
FIG. 4 illustrates a front view of a portion of a disclosed downlight assembly.

Referring to FIG. 2, FIG. 3, and FIG. 4, an exemplary downlight assembly 100 is illustrated in side view (FIG. 2), plan view (FIG. 3) and front elevation view (FIG. 4). The downlight assembly 100 illustrated in FIG. 2 is affixed to a structure 111 that defines or includes the illuminated region 112. Structure 111 may correspond to a canopy fascia panel, such as the fascia panels 92 illustrated in FIG. 1, an exterior wall of a commercial or residential building, and so forth. The illuminated region 112 may represent the exterior surface of structure 111 or a reflective film or sheet (not explicitly depicted) affixed to structure 111. The downlight assembly 100 of FIG. 1 includes a downlight eyebrow 120, a LED string 130, including one or more LED modules 140, and a winged support structure referred to herein as a winged rail 150.

The downlight eyebrow 120 illustrated in FIG. 2 is an elongated L-shaped bracket that includes a first wall 121 and a second wall 122. The first wall 121 illustrated in FIG. 2 extends horizontally from an upper portion of structure 111 while second wall 122 extends vertically downward. The downlight eyebrow 120 illustrated in FIG. 2 further includes a fastening plate 124 affixed to first wall 121. The fastening plate 124 illustrated in FIG. 2 extends beyond an end of first wall 121 and over and onto an upper surface of structure 111. FIG. 2 illustrates a nail, screw, or other fastener 126 affixing an extended portion of fastening plate 124 to the structure 111.

Figure 5:
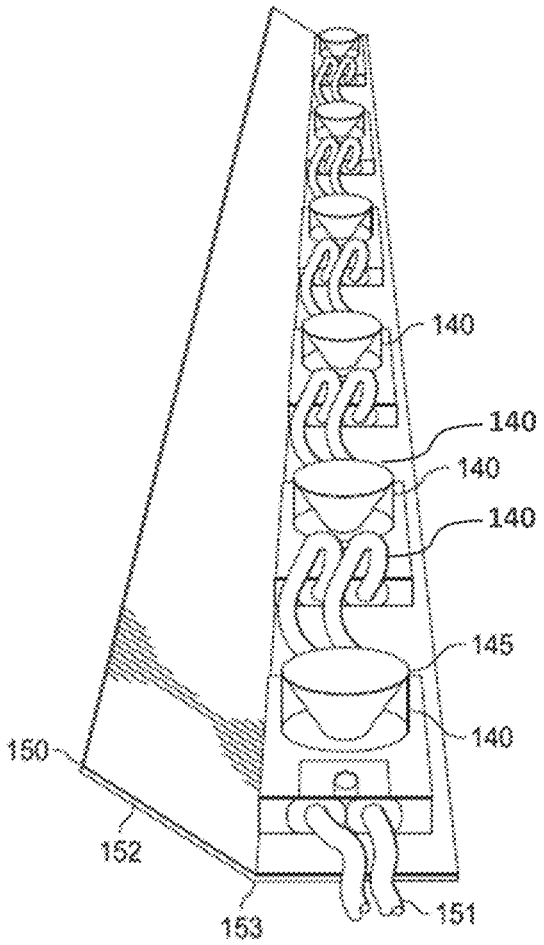
FIG. 5 illustrates a perspective view of an LED string affixed to an inner surface of a winged rail.

The winged rail 150 illustrated in FIG. 1 may be an elongated, monolithic, and/or extruded structure that includes a mounting wing 151 and a reflective wing 152, as best seen in FIG. 5. The mounting wing 151 and reflective wing 152 meet at a common axis 153 and form an obtuse wing angle, which may be in the range of approximately 110 to 165 degrees. The LED string 130 is illustrated affixed to an inward facing surface of the mounting wing 151. The reflective wing 152 extends away and downward from its junction with mounting wing 151, at an acute angle with respect to the first wall 121 of downlight eyebrow 120, and terminates at or in close proximity to the structure 111. By extending from second wall 122 at a free end of mounting wing 151 to the structure 111 at a free end of reflective wing 152, the winged rail 150 illustrated in FIG. 2 comprises a fixed position structure that maintains its position, as well as the position of the LED string 130 attached to mounting wing 151. Maintaining the position of LED string 130 beneficially improves the quality and reliability of the wall wash downlight assembly 100 is able to generate. In addition, the angled reflective wing 152 beneficially reflects light originating from LED module 140 as well as refracted and reflected light from LED module 140 to improve overall appearance of the wall wash by potentially decreasing the vertical attenuation of the wall wash and/or increasing the lateral uniformity of the wall wash, the peak intensity, or both.

In at least one embodiment, some or all of the LED modules 140 include a compound narrow beam lens 145 (see FIG. 5) to constrain the dispersion of light energy emitted by the LED modules 140. As described previously the lens 145 may be characterized by a beam angle of 15 degrees in a first vertically oriented plane and a beam angle of 30 degrees in a second vertically oriented plane that is orthogonal to the first vertically oriented plane. In one such embodiment, the LED modules 140 are oriented wherein the narrower of the two beam angles corresponds to a vertical plane that is parallel to the illuminated region 112 (FIG. 2) while, in another such embodiment, lamp modules are oriented wherein the narrower of the two beam angles is oriented in a vertical plane that is perpendicular to the illuminated region 112.

In an exemplary embodiment of downlight assembly 100 suitable for use in conjunction with a conventional commercial canopies, in which the fascia panel may be disposed 20 to 30 feet or more above the ground with a vertical dimension of 5 feet or more, a downlight assembly 100 employs a 3 inch×3 inch downlight eyebrow profile using white light LED modules with compound narrow beam lenses (e.g., 15×30 degrees beam angle) spaced from 2 to 3 inches apart, e.g., 2.682 inches apart. The winged angle of the winged rail 150 may be in the range of 170 to 150 degrees and the winged rail 150 may be sized to maintain the LED modules 140 displaced a critical distance of 2.0 inches, as an example from the illuminated region.

Figure 6:
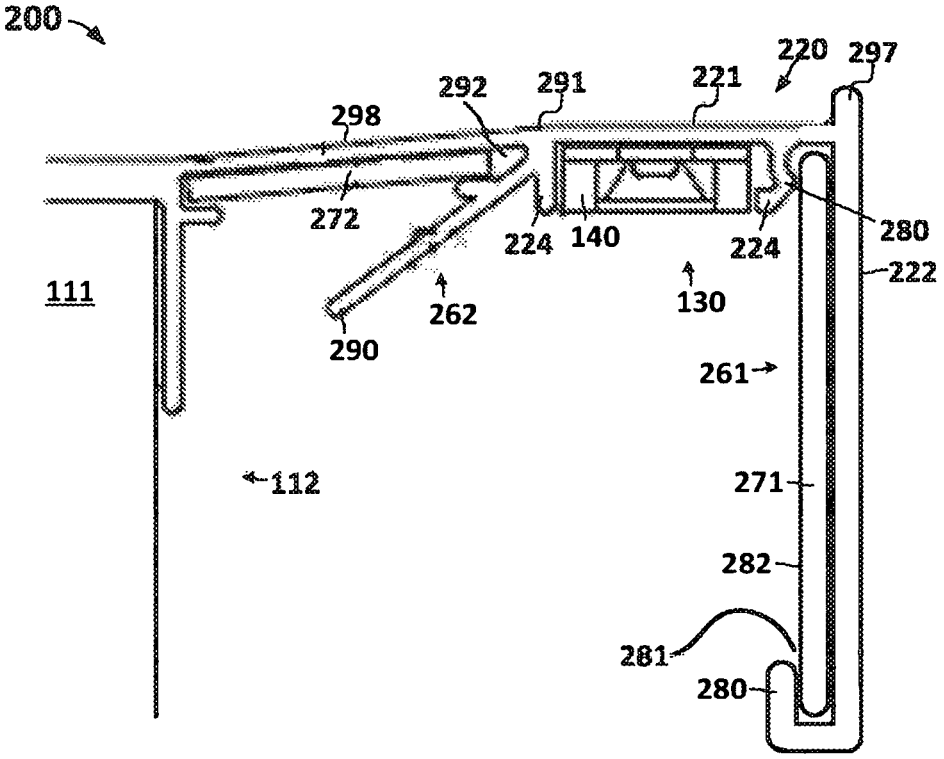
FIG. 6 illustrates a side view of a second downlight assembly.

Referring now to FIG. 6, a sectional view of a downlight assembly 200 is illustrated. In this view, references to the lateral direction refer to a direction perpendicular to the illuminated region 112. The downlight assembly 200 illustrated in FIG. 6 includes an eyebrow frame 220, an LED string 130 including a plurality of LED modules 140*s*, and two or more reflectors include a primary reflector 261 and a secondary reflector 262. The eyebrow frame 220 may be comprised of any suitable material such as aluminum, another metal or metal alloy, or a non-metallic material. The eyebrow frame 220 is configured to be attached to vertical structure 111, such as a wall, fascia, or another suitable vertical structure that includes the illuminated region 112. As depicted in FIG. 6, eyebrow frame 220 is configured wherein the LED string 130 is attached to a lower or downward facing surface of first wall 221 with the LED string 130 oriented to illuminate downward and the LED modules 140*s* are laterally positioned in proximity to second wall 222, displaced from vertical structure 111 by a distance that is approximately equal to the lateral dimension of first wall 221. As depicted in FIG. 6 the position of the LED modules 140 is maintained by snap attach elements 224, which may be integral parts of extruded embodiments of eyebrow frame 220. The primary reflector 261 is illustrated oriented in parallel or substantially in parallel with illuminated region 112 although, in at least some embodiments, primary reflector 261 may be angled with respect to illuminated region 112. The secondary reflector 262 is illustrated as being oriented at an angle with respect to illuminated region 112. Generally, the downlight assembly 200 includes two or more reflectors, configured at different positions and different angles or orientation relative to illuminated region 112, that influence the illumination of illuminated region 112. In combination with embodiments of LED modules 140 that include compound, narrowing lenses as discussed previously, the combination of reflectors reduces the vertical attenuation and improves the lateral uniformity of the illumination and enables the use of an eyebrow frame 220 with a low profile.

The downlight assembly 200 may utilize one or more surfaces of the eyebrow frame 220 to serve as one or more of the reflectors. In at least one such embodiment, an interior surface of second wall 222 functions as the primary reflector 261. In other embodiments, a reflective coating, spray, film, or the like may be applied to the interior surface of second wall 222 to improve its reflective characteristics. In still other embodiments, downlight assembly 200 may include one or more reinforcing structures referred to herein as seam plates, which may be inserted into channels defined by integral elements, sometimes referred to herein as tabs or keys, formed in eyebrow frame 220. In these embodiments, one or more of the reflectors may be provided by a surface of one such seam plate. The downlight assembly 200 illustrated in FIG. 6 includes a first seam plate 271 and a second seam plate 272. The first seam plate 271 is illustrated inserted into a first seam plate channel 281 formed by tab elements 280 which are integrally formed as a part of eyebrow frame 220. In this configuration, the primary reflector 261 is an interior surface 282 of first seam plate 271.

The secondary reflector 262 may be provided by a flange such as the flange 290 illustrated in FIG. 6, which extends from an intermediate point 291 of an interior surface of first wall 221 at a shallow angle 292, e.g., less than approximately 45 degrees. The flange 290 extends of FIG. 6 extends downwards and towards, but not extending all the way to the vertical structure 111. Whereas the reflective wing 152 (FIG. 5) that provided the secondary reflector for the downlight assembly 100 of FIG. 2 extended all the way to the vertical structure 111, in part, to maintain the LED modules 140 in close proximity to the second wall, the flange 290 illustrated in FIG. 6 does not have to maintain the position of LED string 130 because the LED string 130 is maintained by snap attach elements 224. The eyebrow frame of FIG. 6 further includes a water dam tab 297 to prevent water from rain, melting snow, or other sources from running down the exposed surface of second wall 222. An additional water control feature of the eyebrow frame 220 illustrated in FIG. 6 is the use of a slightly inclined portion 298 of first wall 221. The slightly inclined portion 298 of first wall 221 guides rain and other sources of water towards the vertical structure 111 and away from the exposed surface of eyebrow frame 220. The slightly inclined portion may comprise an incline of less than 10 degrees in some embodiments. In some embodiments the slight include may be approximately 5 degrees although other degrees of incline may be used.

In at least one embodiment, the eyebrow frame 220 of FIG. 6 is an elongated and extruded component, i.e., a monolithic component produced by an extrusion process. In such embodiments, the eyebrow frame 220 can be cut to substantially any desired length during or subsequent to the extrusion process. For example, eyebrow frame 220 may be fabricated in one or more standard length sections, e.g., standard lengths of approximately 10, 5, and 2.5 feet. which can be joined together to form longer sections and/or cut after fabrication to produce smaller sections. It should also be appreciated that, although the eyebrow frame 220 illustrated in FIG. 6 is described herein as an extruded eyebrow frame 220, eyebrow frame 220 may be a monolithic component that is produced by a molding process or another type of non-extrusion process.

In the preceding description, the figures and the accompanying description represent exemplary embodiments whereas the disclosed subject matter is intended to encompass all embodiments, including embodiments not specifically depicted, of disclosed subject matter.

What is claimed is:

1. A downlight assembly, comprising:

an eyebrow frame configured to attach to a structure in proximity to a plane of intended illumination (POI);

a light emitting diode (LED) string attached to the eyebrow frame and configured to illuminate the POI, wherein the LED string includes a plurality of LED modules;

a primary reflector configured to reflect at least some light produced by the LED string, wherein the primary reflector is oriented at a first angle relative to the POI; and a secondary reflector oriented at a second angle relative to the POI, wherein the first angle and the second angle differ and wherein the first reflective plane and the second reflective plane are configured to influence the illumination of the POI wherein the eyebrow frame includes:

a first leg including a first end configured to attach to the structure; and a second leg, wherein the second leg includes a first end connected to a second end of the first leg, wherein the second leg is parallel or substantially parallel to the POI and wherein a displacement between the second leg and the POI is in accordance with a length and configuration of the first leg; and a water tab in proximity to the first end of the second leg, wherein the water tab extends upwardly from the first end of the second leg to reduce runoff of water over an exterior surface of the second leg.

2. The downlight assembly of claim 1, wherein the primary reflector comprises an element selected from a group of elements comprising:

an inner surface of the first leg;

a reflective coating applied to the inner surface of the first leg; and a surface of a seam plate affixed to the eyebrow frame in proximity to the second leg.

3. The downlight assembly of claim 2, wherein the eyebrow frame includes one or more seam plate tabs configured to retain the seam plate in proximity to the second leg.

4. The downlight assembly of claim 1, wherein the eyebrow frame cross section includes a flange, wherein a first end of the flange is attached to an intermediate point of an interior surface of the first leg and wherein the flange defines an acute angle with the first leg.

5. The downlight assembly of claim 4, wherein the secondary reflector comprises an element selected from the group of elements comprising:

a surface of the flange; and a secondary seam plate positioned in proximity to the flange.

6. The downlight assembly of claim 5, wherein the eyebrow frame includes one or more secondary seam plate tabs configured to retain the secondary seam plate in proximity to the flange.

7. The downlight assembly of claim 1, wherein the first leg includes a sloped portion, wherein the sloped portion is oriented at an angle sufficient to guide water towards the first end.

8. The downlight assembly of claim 1, wherein the first leg includes snap fit tabs suitable for receiving the LED string.

9. The downlight assembly of claim 1, wherein the POI comprises a substantially vertical surface and further wherein the LED string is attached to the eyebrow frame with the plurality of LED modules oriented downwards, wherein the LED string illuminates primarily in a downward direction.

10. The downlight assembly of claim 9, wherein each of the plurality of LED modules includes:

one or more LEDs; and a narrowing lens, wherein the narrowing lens constrains dispersion of light from the one or more LEDs.

11. The downlight assembly of claim 9, wherein the narrowing lens constrains dispersion of light in a particular plane, wherein the particular plane is perpendicular to the POI.

12. The downlight assembly of claim 9, wherein the narrowing lens constrains dispersion of light in a particular plane, wherein the particular plane is parallel to the POI.

13. The downlight assembly of claim 9, wherein the narrowing lens constrains dispersion of light in a particular plane in accordance with a particular beam angle, wherein the particular beam angle is less than or equal to 60 degrees.

14. The downlight assembly of claim 13, wherein the particular beam angle is less than or equal to 45 degrees.

15. The downlight assembly of claim 9, wherein the narrowing lens comprises a compound narrowing lens, wherein the compound narrowing lens constrains dispersion of light in a first particular plane in accordance with a first beam angle and further wherein the compound narrowing lens constrains dispersion of light in a second particular plane in accordance with a second beam angle.

16. The downlight assembly of claim 15, wherein the first particular plane is perpendicular to the second particular plane, the first beam angle is in the range of 10 degrees to 20 degrees and the second beam angle is in the range of 25 to 35 degrees.

17. The downlight assembly of claim 1, wherein the eyebrow frame comprises an extruded eyebrow frame formed as a monolithic structure with an extrusion process.

18. The downlight assembly of claim 1, wherein the eyebrow frame comprises an assembled frame, wherein the assembled frame include two or more components affixed to each other to form the eyebrow frame.

* * * * *